US008025036B2

(12) United States Patent
Noguchi

(10) Patent No.: US 8,025,036 B2
(45) Date of Patent: Sep. 27, 2011

(54) VALVE TIMING CONTROL APPARATUS

(75) Inventor: Yuji Noguchi, Obu-shi (JP)

(73) Assignee: Aisin Seiki Kabushiki Kaisha, Kariya-shi, Aichi-ken (JP)

( * ) Notice: Subject to any disclaimer, the term of this patent is extended or adjusted under 35 U.S.C. 154(b) by 417 days.

(21) Appl. No.: 12/275,244

(22) Filed: Nov. 21, 2008

(65) Prior Publication Data

US 2009/0145385 A1 Jun. 11, 2009

(30) Foreign Application Priority Data

Dec. 7, 2007 (JP) ..... 2007-317086

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,941,912 | B2 | 9/2005 | Palesch et al. | |
| 2003/0196618 | A1* | 10/2003 | Simpson | 123/90.15 |
| 2005/0087713 | A1 | 4/2005 | Kawai et al. | |
| 2007/0095316 | A1 | 5/2007 | Hisahara et al. | |
| 2007/0251477 | A1 | 11/2007 | Nozawa et al. | |

FOREIGN PATENT DOCUMENTS

| | | | |
|---|---|---|---|
| DE | 10 2007 000 249 | A1 | 10/2007 |
| EP | 1 510 662 | A1 | 3/2005 |
| EP | 1 780 383 | A1 | 5/2007 |
| JP | 10-280919 | A | 10/1998 |
| JP | 11-343824 | A | 12/1999 |
| JP | 2005-517109 | A | 6/2005 |

OTHER PUBLICATIONS

Extended European Search Report issued in EP 08 02 0566, May 11, 2009, EPO, Munich, DE.
U.S. Appl. No. 11/649,820, filed Jan. 5, 2007, Ogawa et al.

* cited by examiner

*Primary Examiner* — Zelalem Eshete
(74) *Attorney, Agent, or Firm* — Buchanan Ingersoll & Rooney PC

(57) ABSTRACT

A valve timing control apparatus includes a driving rotation member, a driven rotation member, an advance angle chamber displacing a rotation phase of the driven rotation member relative to the driving rotation member in an advance angle direction, a retard angle chamber displacing the relative rotation phase in a retard angle direction, an advance angle oil passage, a retard angle oil passage, an oil pump, a passage switching valve switching a position between first and second positions, and a drain mechanism provided between the passage switching valve and at least one of the advance angle chamber and the retard angle chamber to accelerate discharge of the hydraulic fluid from one of the advance angle chamber and the retard angle chamber when the hydraulic fluid is supplied to the other of the advance angle chamber and the retard angle chamber.

15 Claims, 8 Drawing Sheets

VALVE TIMING CONTROL APPARATUS

CROSS REFERENCE TO RELATED APPLICATIONS

This application is based on and claims priority under 35 U.S.C §119 with respect to Japanese Patent Application 2007-317086, filed on Dec. 7, 2007, the entire content of which is incorporated herein by reference.

FIELD OF THE INVENTION

This invention relates to a valve timing control apparatus.

BACKGROUND

A valve timing control apparatus is disclosed in JP H10-280919A. In the valve timing control apparatus disclosed in Paragraph 0029 and FIG. 1 of JP H10-280919A, for example, when a hydraulic fluid is supplied from an advance angle oil passage to an advance angle chamber for displacing the relative rotation phase in an advance angle direction, the hydraulic fluid in a retarded angle chamber is discharged from a retard angle oil passage to an oil pan through a one way drain control passage and a fourth port of a passage switching valve. Then, a pressure of the retard angle chamber becomes low and the relative rotation phase is displaced to advance the opening and closing timing of an intake valve.

However, in the valve timing control apparatus disclosed in JP H10-280919A, the drainage is conducted through a relative narrow port of the passage switching valve. Thus, when the hydraulic fluid is rapidly supplied to the advance angle chamber through the advance angle oil passage for displacing the relative rotation phase in the advance angle direction quickly, back pressure resistance occurs in the hydraulic fluid in the retard angle oil passage. Similarly, when the hydraulic fluid is rapidly supplied to the retard angle chamber through the retard angle oil passage for displacing the relative rotation phase in the retard angle direction quickly, back pressure resistance occurs in the hydraulic fluid in the retard angle oil passage. Accordingly, the rapid displacement of the relative rotation phase becomes difficult, and therefore responsiveness of the valve timing control apparatus is not sufficiently enhanced.

A need exists for a valve timing control apparatus which is not susceptible to the drawback mentioned above.

SUMMARY OF THE INVENTION

According to an aspect of the present invention, a valve timing control apparatus includes a driving rotation member synchronously rotating with a crankshaft of an internal combustion engine, a driven rotation member coaxially arranged with the driving rotation member and synchronously rotating with a camshaft for opening and closing a valve of the internal combustion engine, an advance angle chamber defined by the driving rotation member and the driven rotation member and displacing a rotation phase of the driven rotation member relative to the driving rotation member in an advance angle direction when the hydraulic fluid is supplied thereto, a retard angle chamber defined by the driving rotation member and the driven rotation member and displacing the rotation phase of the driven rotation member relative to the driving rotation member in a retard angle direction when the hydraulic fluid is supplied thereto, an advance angle oil passage through which the hydraulic fluid is supplied to or discharged from the advance angle chamber, a retard angle oil passage through which the hydraulic fluid is supplied to or discharged from the retard angle chamber, an oil pump supplying the hydraulic fluid to the advance angle oil passage and the retard angle oil passage, a passage switching valve switching a position thereof between a first position, in which an output portion of the oil pump communicates with the advance angle oil passage, and a second position, in which the output portion communicates with the retard angle oil passage, and a drain mechanism provided between the passage switching valve and at least one of the advance angle chamber and the retard angle chamber to accelerate discharge of the hydraulic fluid from one of the advance angle chamber and the retard angle chamber when the hydraulic fluid is supplied to the other of the advance angle chamber and the retard angle chamber.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
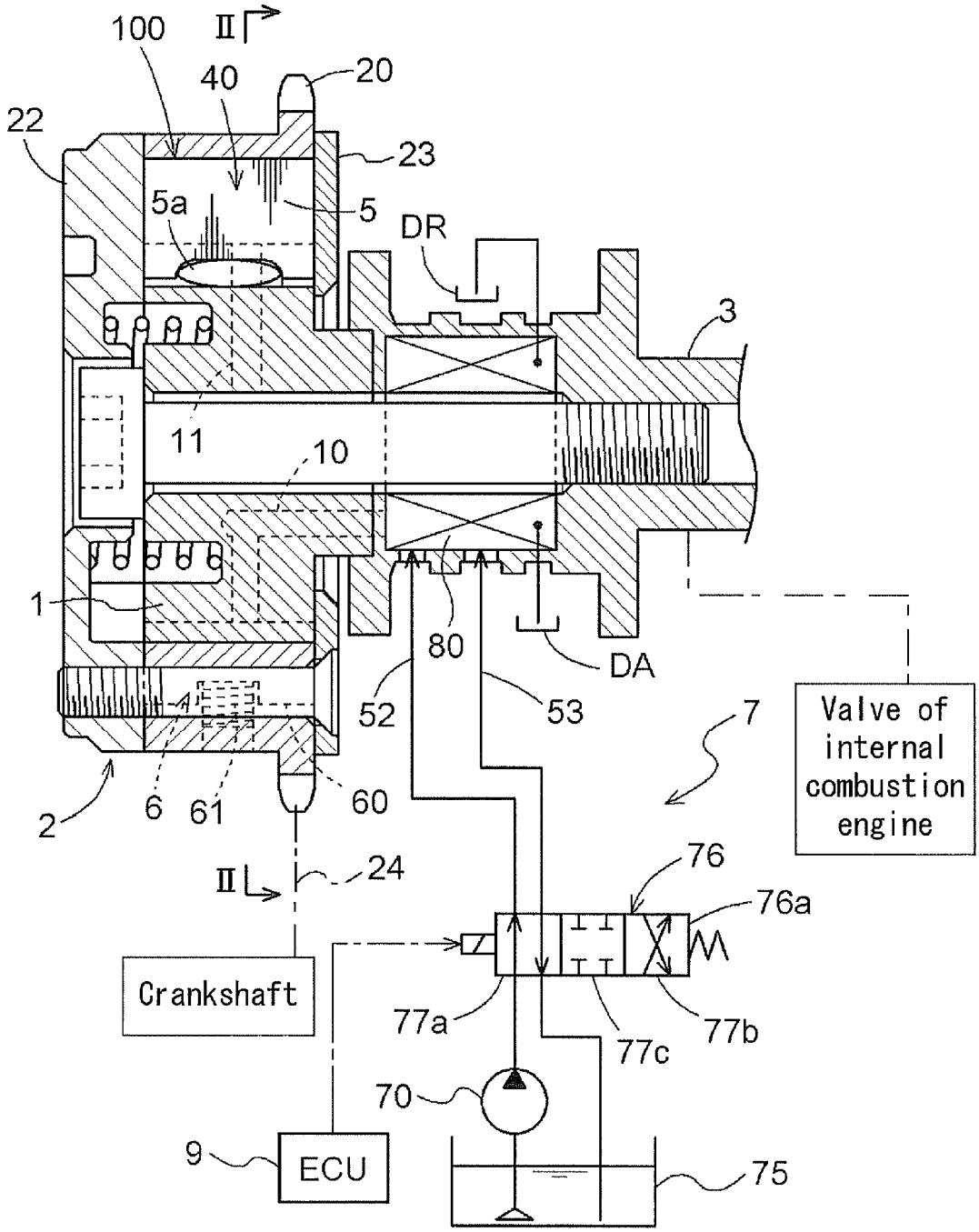
FIG. 1 is a vertically cutaway side view showing an overview of a valve timing control apparatus.
Figure 2:
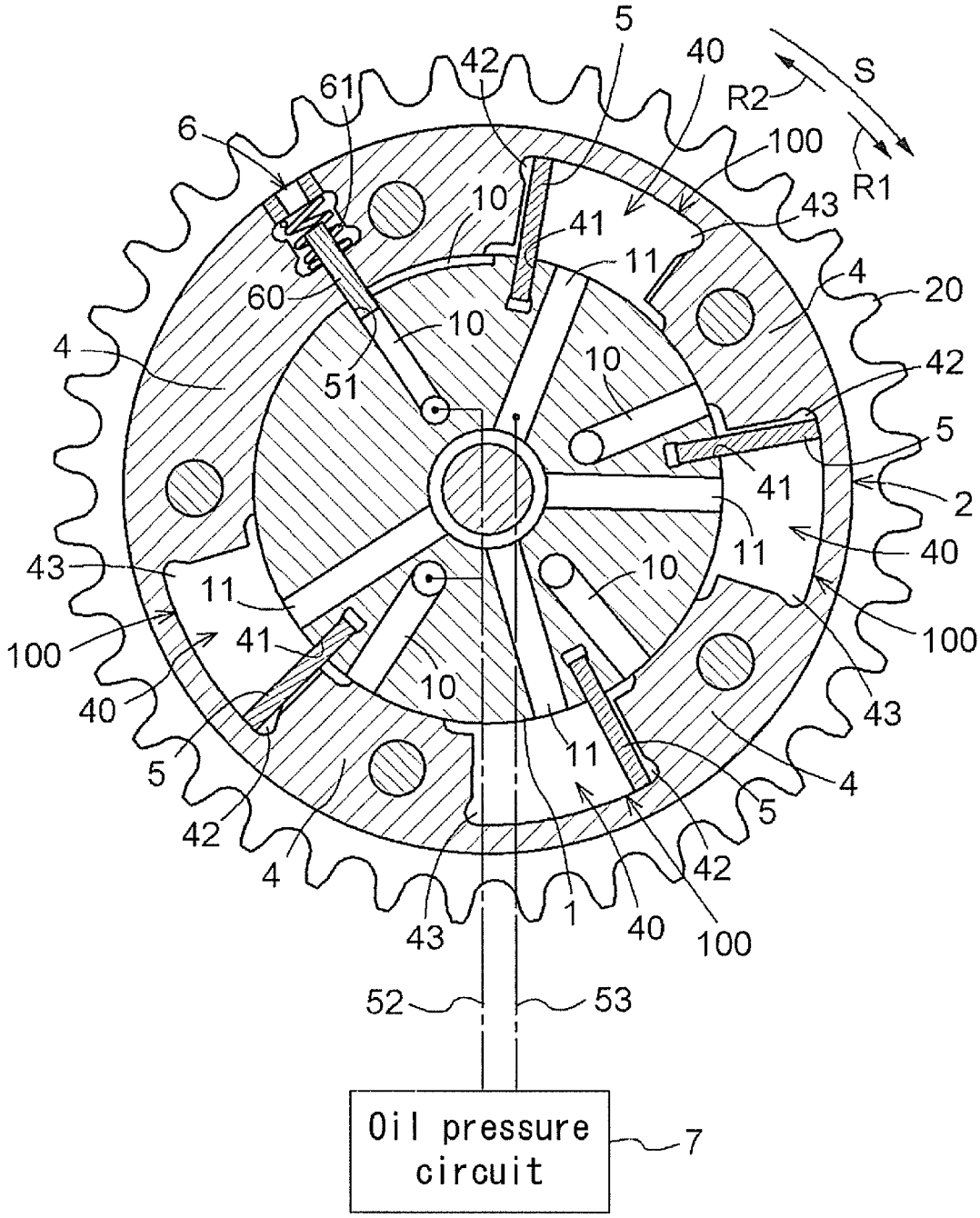
FIG. 2 is a side view taken along a line II-II of the valve timing control apparatus shown in FIG. 1.

As shown in FIG. 1, a valve timing control apparatus according to a first embodiment of the invention includes an actuator 100 which is constructed by an external rotor 2 serving as a driving rotation member and an internal rotor 1 serving as a driven rotation member. The external rotor 2 synchronously rotates with a crankshaft of a vehicle engine, and the internal rotor 1 is coaxially arranged with the external rotor 2 and integrally rotates with a camshaft 3. The relative rotation phase between the external rotor 2 and the internal rotor 1 is variably controlled. FIG. 2 is a sectional view taken along a line II-II of FIG. 1.

The internal rotor 1 is integrally assembled to a distal end of the camshaft 3 which is supported so as to integrally rotate with a cylinder head of the engine. The external rotor 2 sheathes the internal rotor 1 so as to relatively rotate with the internal rotor 1 in a predetermined relative rotation phase range. The external rotor 2 includes a front plate 22, a rear plate 23 and a timing sprocket 20 integrally formed on an outer circumference of the external rotor 2. The timing sprocket 20 synchronously rotates with the crankshaft of the engine by a power transmitting member such as a timing chain or a timing belt.

Thus, when the crankshaft of the engine is driven to rotate, the external rotor 2 including the timing sprocket 20 rotates in a rotation direction S indicated in FIG. 2. In response to the rotation of the external rotor 2, the internal rotor 1 and the camshaft 3 rotate in the rotation direction S. Consequently, a cam provided at the camshaft 3 pushes down an intake valve or an exhaust valve to open.

As shown in FIG. 2, multiple projecting portions 4, each serving as a shoe projecting in a radial inner direction, are provided at the external rotor 2. The projecting portions 4 are arranged along the rotation direction spacing away from each other. Multiple fluid pressure chambers 40, enclosed by the external rotor 2 and the internal rotor 1, are formed between the projecting portions 4.

A vane groove 41 is formed at a position on an outer circumference of the internal rotor 1 that faces each fluid pressure chamber 40. A vane 5 is slidably inserted into each vane groove 41 along the radial direction for dividing each fluid pressure chamber 40 into an advance angle chamber 42 and a retard angle chamber 43. The vane 5 is biased in a radial outer direction by a spring 5*a* provided at an inner diameter side thereof. Here, advance and retard angles indicate a relationship between a valve opening and closing timing and a rotation phase of the crankshaft. The more the vane 5 is relatively displaced in a direction that the cubic capacity of the advance angle chamber 42 increases (a direction indicated by an arrow R1) in accordance with change of the relative rotation phase between the internal rotor 1 and the external rotor 2, the more the opening and closing timing of the valve is advanced with respect to the rotation phase of the crankshaft. Conversely, the more the vane 5 is relatively displaced in a direction that the cubic capacity of the retard angle chamber 43 increases (a direction indicated by an arrow R2), the more the opening and closing timing of the valve is retarded.

The advance angle chamber 42 is in communication with an advance angle passage 10 formed in the internal rotor 1, and the retard angle chamber 43 is in communication with a retard angle passage 11 formed in the internal rotor 1. The advance angle passage 10 and the retard angle passage 11 are connected with an oil pressure circuit 7, which will be described below.

A lock mechanism 6 is provided between the internal rotor 1 and the external rotor 2 for restricting the relative rotation between the internal rotor 1 and the external rotor 2 when the relative rotation phase lies at a predetermined locking phase (a phase shown in FIG. 2) set between the most advanced angle phase and the most retarded angle phase. FIG. 2 shows that the most retarded angle locking phase, which is set so that the opening and closing timing of the intake valve of the engine is adjusted to enable smooth start of the engine.

The lock mechanism 6 includes a lock body 60 which changes its position between a lock position and an unlock position. In the lock position, the lock body 60 projects from the external rotor 2 into an engagement recessed portion 51 of the internal rotor 1 by a spring 61 to restrict the relative rotation between the rotation members, i.e., the internal rotor 1 and the external rotor 2. In the unlock position, the lock body 60 is pushed out from the engagement recessed portion 51 by a pressure applied to the hydraulic fluid in the advance angle passage 10 against a biasing force of the spring 61 and allows the relative rotation between the rotation members.

The oil pressure circuit 7 is meant for supplying and discharging the hydraulic fluid to/from the advance angle chamber 42 and the retard angle chamber 43, and basically conducts these operations through the advance angle passage 10 or the retard angle passage 11. In response to these operations, the position of the vane 5 is changed in the fluid pressure chamber 40 to adjust the relative rotation phase between the external rotor 2 and the internal rotor 1 between the most advanced angle phase (a relative rotation phase that the cubic measurement of the advance angle chamber 42 is maximized) and the most retarded angle phase (a relative rotation phase that the cubic measurement of the retard angle chamber 43 is maximized). As just described, the oil pressure circuit 7 functions as a relative rotation phase adjusting mechanism and also is used for unlocking the lock body 60.

As shown in FIG. 1, the oil pressure circuit 7 includes an advance angle oil passage 52, a retard angle oil passage 53 and an oil pump 70 which is driven by a driving force of the engine to pump the hydraulic fluid. The advance angle oil passage 52 supplies or discharges the hydraulic fluid to/from the advance angle chamber 42 through the advance angle passage 10, and the retard angle oil passage 53 supplies or discharges the hydraulic fluid to/from the retard angle chamber 43 through the retard angle passage 11. The oil pressure circuit 7 further includes a passage switching valve 76 which is switchable between first, second, and third positions. In the first position, the output portion of the oil pump 70 communicates with a proximal end portion of the advance angle oil passage 52. In the second position, the output portion communicates with a proximal end portion of the retard angle oil passage 53. In the third position, the output portion of the oil pump 70 is shut off from the advance angle oil passage 52 and the retard angle oil passage 53. An input portion of the oil pump 70 is in communication with an oil pan 75 in which the hydraulic fluid is reserved.

Figure 3:
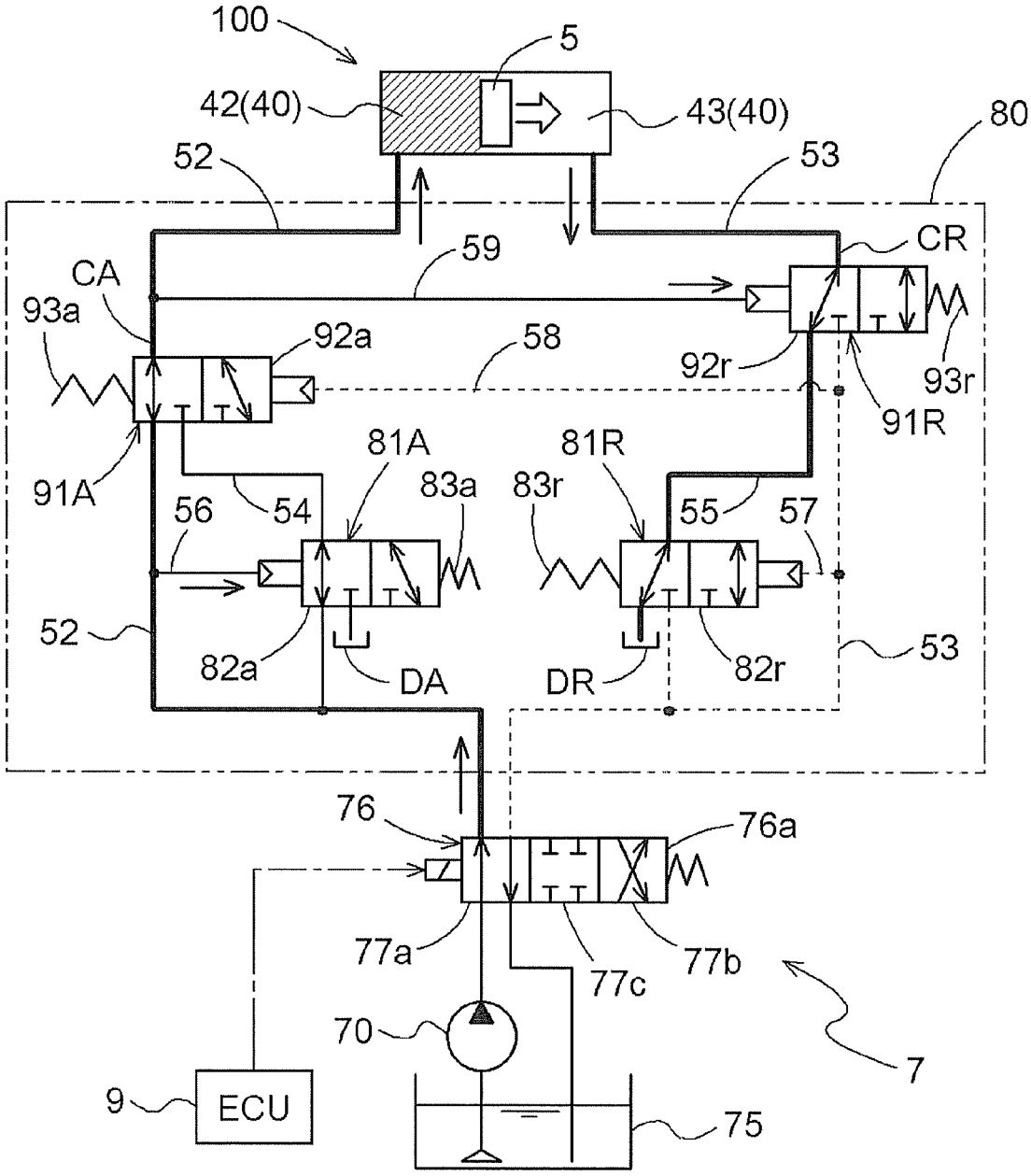
FIG. 3 is a schematic view showing a depressuring drain mechanism when a relative rotation phase between an internal rotor and an external rotor is displaced in a R1 direction.
Figure 4:
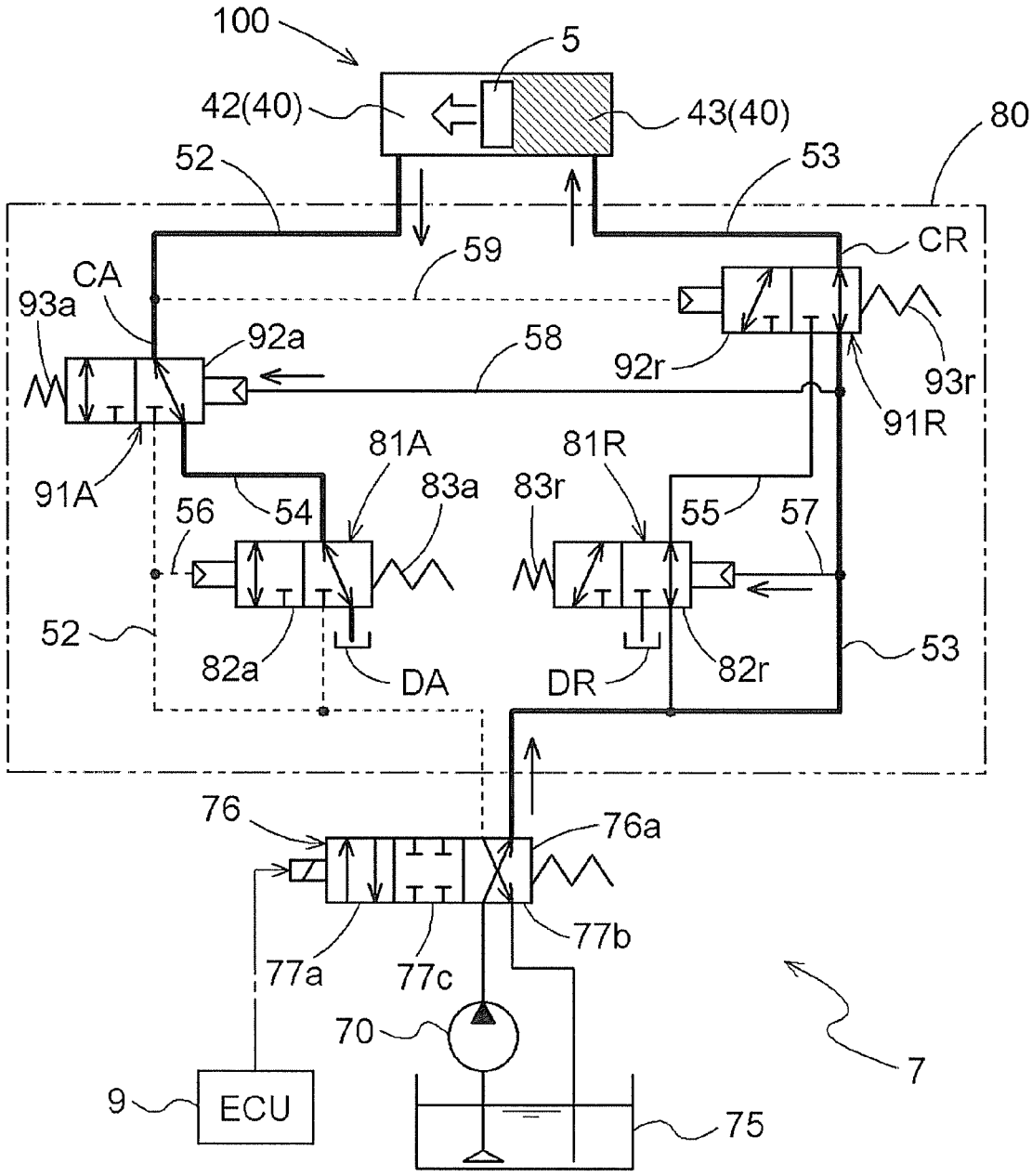
FIG. 4 is a schematic view showing the depressuring drain mechanism when the relative rotation phase between the internal rotor and the external rotor is displaced in a R2 direction.
Figure 5:
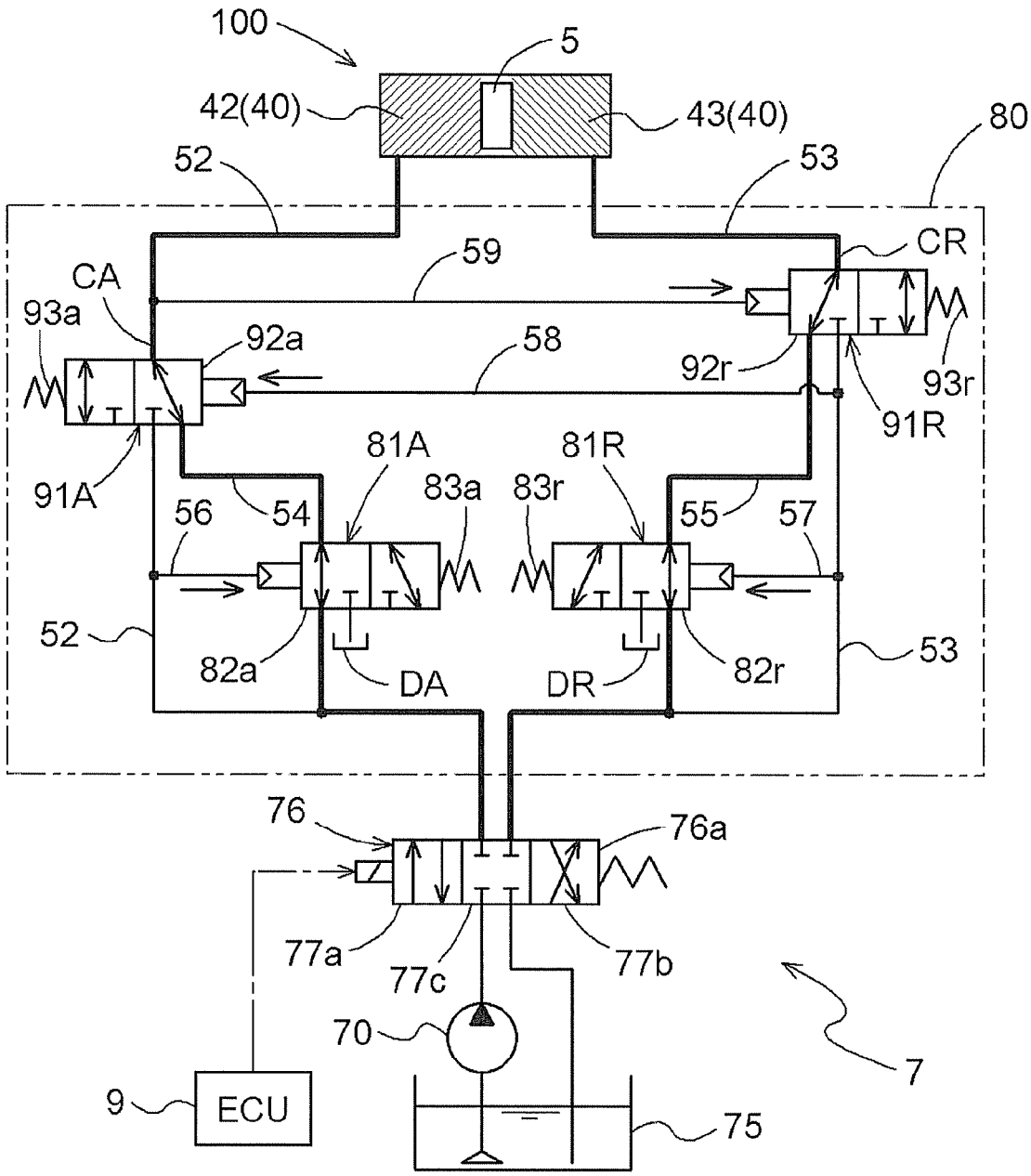
FIG. 5 is a schematic view showing the depressuring drain mechanism when valve opening and closing timing, relative to a rotation phase of the crankshaft, is held at an intermediate phase.

The passage switching valve 76 includes a spool 76*a* which switches its position in a horizontal direction of FIG. 1 by a solenoid (not shown) based on power supply control conducted by an ECU 9. The spool 76*a* has three sections 77*a*, 77*b* and 77*c*, which are different from each other. As shown in FIGS. 1 and 3, when the spool 76*a* is positioned at a rightmost first position, the output portion of the oil pump 70 is connected with the advance angle oil passage 52 through an oil fill port in the first section 77*a*. On the other hand, as shown in FIG. 4, when the spool 76*a* is positioned at a leftmost second position, the output portion of the oil pump 70 is connected with the retard angle oil passage 53 through an oil fill port in the second section 77*b*. Further, as shown in FIG. 5, when the spool 76*a* is positioned at the intermediate third position, the output portion of the oil pump 70 is shut off from the advance angle oil passage 52 and the retard angle oil passage 53 by the third section 77*c*. If the hydraulic fluid is supplied to the advance angle chamber 42 by the oil pump 70, the relative rotation phase is displaced in an advance angle direction. If the hydraulic fluid is supplied to the retard angle chamber 43 by the oil pump 70, the relative rotation phase is displaced in a retard angle direction.

When the spool 76*a* is positioned at the rightmost first position, a drain passage, ranging from the retard angle oil passage 53 to the oil pan 75 through an oil discharge port of the first section 77*a*, is formed. Similarly, when the spool 76*a* is positioned at the leftmost second position, a drain passage, ranging from the advance angle oil passage 52 to the oil pan 75 through an oil discharge port of the second section 77*b*, is formed. When the spool 76*a* is positioned at the intermediate third position, the drain passages, respectively ranging from the advance angle oil passage 52 and the retard angle oil passage 53 to the oil pan 75, are shut off by the third section 77*c*.

(Depressuring Drain Mechanism 80)

The most remarkable feature of the valve timing control apparatus according to the embodiment is providing a depressuring drain mechanism 80, meant for releasing the hydraulic fluid in the retard angle oil passage 53 to the atmosphere when the hydraulic fluid is supplied from the advance angle oil passage 52 to the advance angle chamber 42 by the oil pump 70 or releasing when the hydraulic fluid in the advance angle oil passage 52 to the atmosphere when the hydraulic fluid is supplied from the retard angle oil passage 53 to the retard angle chamber 43 by the oil pump 70, between the actuator 100 and the passage switching valve, not between the passage switching valve 76 and the oil pump 70. In other words, the drain mechanism 80 is provided at a downstream side of the passage witching valve 76 with respect to a direction that the hydraulic fluid is supplied by the oil pump 70. When the cubic measurement of the retard angle chamber 43 or the cubic measurement of the advance angle chamber 42 is reduced due to the movement of the vane 5, the depressuring drain mechanism 80 accelerates the discharge of the hydraulic fluid from the retard angle oil passage 53 or the advance angle oil passage 52, thereby promptly releasing back pressure in the retard angle oil passage 53 or in the advance angle oil passage 52 as necessary (releasing the hydraulic fluid to the atmosphere). The hydraulic fluid is not flowed off from the advance angle oil passage 52 and the retard angle oil passage 53 by the depressuring drain mechanism 80. The hydraulic fluid drained from the depressuring drain mechanism 80 is discharged to a journal of the engine and the like and returned to the oil pan 75 eventually.

As shown in FIG. 1, the depressuring drain mechanism 80 is provided at a proximal end side of the internal rotor 1. As understood from circuit development elevations of the depressuring drain mechanism 80 shown in FIGS. 3 to 5, a short advance angle drain passage 54 and a short retard angle drain passage 55 are respectively formed in the advance angle oil passage 52 and the retard angle oil passage 53 so that each drain passage creates a bypass. A total of four hydraulically-operated pilot valves are located at parts of the advance angle bypass oil passage 54 and the retard angle bypass oil passage 55 (the advance angle drain passage 54 and the retard angle drain passage 55) to form the depressuring drain mechanism 80.

(Main Drain Valve)

An advance angle drain valve 81A (One example of the main drain valve) is provided at an intermediate position of the first bypass oil passage 54, i.e. the advance angle drain passage 54 of the advance angle oil passage 52, and a retard angle drain valve 81R (another example of the main drain valve) is provided at an intermediate position of the second bypass oil passage 55, i.e. the retard angle drain passage 55 of the retard angle oil passage 53. Only these two valves, out of the four pilot valves included in the depressuring drain mechanism 80, actually functions as drainage.

The advance angle drain valve 81A (advance angle oil passage drain mechanism) includes a valve body 82*a* changing its position between a drainage position (advance angle drainage position) and a non-drainage position (advance angle non-drainage position) and an advance angle first spring 83*a* biasing the valve body 82*a* toward the drainage position. Further, a drainage quitting passage 56 (one example of an operation passage), through which a pressuring force applied to the advance angle oil passage 52 is exerted on the valve body 82*a* to push the valve body 82*a* to the non-drainage position against the biasing force of the retard angle first spring 83*a*, is provided between the valve body 82*a* and the advance angle oil passage 52. A depressuring drain receiver DA (advance angle drain receiver) is located adjacent to a part of the valve body 82*a*. Thus, the advance angle drain valve 81A is switched between a drainage state and a non-drainage state depending on a positional relationship among the advance angle drain passage 54, the depressuring drain receiver DA and the multiple ports formed in the valve body 82*a*. Basically, when a pressuring force for advance angle on the hydraulic fluid becomes smaller than a predetermined value (first predetermined value) in the advance angle oil passage 52, the advance angle drain valve 81A is operated to be in the drainage state by the biasing force of the advance angle first spring 83*a* as shown in FIG. 4. On the other hand, when the pressuring force for advance angle is exerted on the advance angle oil passage 52, the advance angle drain valve 81A is subject to the pressuring force on the advance angle oil passage 52 through the drainage quitting passage 56 and is switched to be in the non-drainage state as shown in FIG. 3.

Similarly, the retard angle drain valve 81R (the retard angle oil passage drain mechanism) includes a valve body 82*r* changing its position between a drainage position (retard angle drainage position) and a non-drainage position (retard angle non-drainage position) and a retard angle first spring 83*r* biasing the valve body 82*r* toward the drainage position. Further, a drainage quitting passage 57 (another example of the operation oil passage), through which a pressuring force applied to the retard angle oil passage 53 is exerted on the valve body 82*r* to push the valve body 82*r* to the non-drainage position against the biasing force of the retard angle first spring 83*r*, is provided between the valve body 82*r* and the retard angle oil passage 53. A depressuring drain receiver DR (retard angle drain receiver) is located adjacent to a part of the valve body 82*r*. Thus, the retard angle drain valve 81R is switched between a drainage state and a non-drainage state depending on a positional relationship among the retard angle drain passage 55, the depressuring drain receiver DR and the multiple ports formed in the valve body 82*r*. Basically, when a pressuring force for retard angle on the hydraulic fluid becomes smaller than a predetermined value (second predetermined value) in the retard angle oil passage 53, the retard angle drain valve 81R is operated to be in the drainage state by the biasing force of the retard angle first spring 83*r* as shown in FIG. 3. On the other hand, when the pressuring force for retard angle is exerted on the retard angle oil passage 53, the retard angle drain valve 81R is subject to the pressing force on the retard angle oil passage 53 through the drainage quitting passage 57 and is switched to be in the non-drainage state as shown in FIG. 4.

(Auxiliary Drain Valve)

An advance angle auxiliary valve 91A is located at a bifurcation area CA of the advance angle oil passage 52 and the advance angle drain passage 54, which is located close to the actuator 100, for assisting operation of the advance angle drain valve 81A. Similarly, a retard angle auxiliary valve 91R is located at a bifurcation area CR of the retard angle oil passage 53 and the retard angle drain passage 55, which is located close to the actuator 100, for assisting operation of the retard angle drain valve 81R.

The advance angle auxiliary valve 91A includes a valve body 92*a* changing its position between a drainage position and a non-drainage position. In the drainage position of the advance angle auxiliary valve 91A, as shown in FIG. 4, a communication is opened between the bifurcation area CA of the advance angle oil passage 52 and the advance angle drain passage 54. At the same time, a section of the advance angle oil passage 52 is shut off to disconnect the bifurcation area CA of the advance angle oil passage 52 from the passage switching valve 76. On the other hand, in the non-drainage position of the advance angle auxiliary valve 91A, as shown in FIG. 3, the section of the advance angle oil passage 52 is opened to connect the bifurcation area CA of the advance angle oil passage 52 with the passage switching valve 76. At the same time, the communication is shut off between the bifurcation area CA of the advance angle oil passage 52 and the advance angle drain passage 54. The advance angle auxiliary valve 91A further includes an advance angle second spring 93*a* biasing the valve body 92*a* toward the non-drainage position. Further, an advance angle auxiliary operation passage 58, through which the pressuring force is exerted on the valve body 92*a* to push the valve body 92*a* to the drainage position against the biasing force of the advance angle second spring 93*a*, is provided between the valve body 92*a* and the retard angle oil passage 53.

Similarly, the retard angle auxiliary valve 91R includes a valve body 92*r* changing its position between a drainage position and a non-drainage position. In the drainage position of the retard angle auxiliary valve 91R, as shown in FIG. 3, a communication is opened between the bifurcation area CR of the retard angle oil passage 53 and the retard angle drain passage 55. At the same time, a section of the retard angle oil passage 53 is shut off to disconnect the bifurcation area CR of the retard angle oil passage 53 from the passage switching valve 76. On the other hand, in the non-drainage position of the retard angle auxiliary valve 91R, as shown in FIG. 4, the section of the retard angle oil passage 53 is opened to connect the bifurcation area CR of the retard angle oil passage 53 with the passage switching valve 76. At the same time, the communication is shut off between the bifurcation area CR of the retard angle oil passage 53 and the retard angle drain passage 55. The retard angle auxiliary valve 91R includes a retard angle second spring 93*r* biasing the valve body 92*r* toward the non-drainage position. Further, a retard angle auxiliary operation passage 59, through which the pressuring force is exerted on the valve body 92*r* to push the valve body 92*r* to the drainage position against the biasing force of the retard angle second spring 93*r*, is provided between the valve body 92*r* and the advance angle oil passage 52.

As shown in FIG. 3, when the solenoid of the passage switching valve 76 is switched to be in its on state, the passage switching valve 76 is positioned at the first position in which the output portion of the oil pump 70 connects with the advance angle oil passage 52, and the hydraulic fluid in the oil pan 75 is supplied to the advance angle oil passage 52 by the oil pump 70. In case that the passage switching valve 76 is held at the first position, the pressuring force on the hydraulic fluid in the advance angle oil passage 52 increases, and the advance angle drain valve 81A is subject to the oil pressure exerted through the drainage quitting passage 56 to be held at the non-drainage position. At the same time, the retard angle auxiliary valve 91R is subject to the pressuring force on the hydraulic fluid in the advance angle oil passage 52 exerted through the retard angle auxiliary operation passage 59 to be held at the drainage position. At this time, the sufficient pressuring force from the oil pump 70 is not exerted on the retard angle oil passage 53. Accordingly, the sufficient oil pressure is not exerted on the advance angle auxiliary operation passage 58 and the advance angle auxiliary valve 91A is held at the non-drainage position. Similarly, the sufficient oil pressure is not exerted on the drainage quitting passage 57, and the retard angle drain valve 81R is held at the drainage position. As a result, back pressure existing in the retard angle oil passage 53 is instantly released to the atmosphere through the retard angle drain valve 81R, and the hydraulic fluid is supplied to the advance angle chamber 42 at high efficiency. In a short time period immediately before the retard angle auxiliary valve 91R is switched to be in the drainage position, back pressure of the hydraulic fluid between the retard angle auxiliary valve 91R and the passage switching valve 76 may be drained from the oil discharge port of the passage switching valve 76 to the oil pan 75.

Conversely, as shown in FIG. 4, when the solenoid of the passage switching valve 76 is switched to be in its off state, the passage switching valve 76 is positioned at the second position in which the output portion of the oil pump 70 connects with the retard angle oil passage 53, and the hydraulic fluid in the oil pan 75 is supplied to the retard angle oil passage 53 by the oil pump 70. In case that the passage switching valve 76 is held at the second position, the pressuring force on the hydraulic fluid in the retard angle oil passage 53 increases, and the retard angle drain valve 81R is subject to the oil pressure exerted through the drainage quitting passage 57 to be held at the non-drainage position. At the same time, the advance angle auxiliary valve 91A is subject to the pressuring force on the hydraulic fluid in the retard angle oil passage 53 exerted through the advance angle auxiliary operation passage 58 to be held at the drainage position. At this time, the sufficient pressuring force from the oil pump 70 is not exerted on the advance angle oil passage 52. Accordingly, the sufficient oil pressure is not exerted on the retard angle auxiliary operation passage 59 and the retard angle auxiliary valve 91R is held at the non-drainage position. Similarly, the sufficient oil pressure is not exerted on the drainage quitting passage 56, and the advance angle drain valve 81A is held at the drainage position. As a result, back pressure existing in the advance angle oil passage 52 is instantly released to the atmosphere through the advance angle drain valve 81A, and the hydraulic fluid is supplied to the retard angle chamber 43 at high efficiency. In a short time period immediately before the advance angle auxiliary valve 91A is switched to be in the drainage position, back pressure of the hydraulic fluid between the advance angle auxiliary valve 91A and the passage switching valve 76 may be drained from the oil discharge port of the passage switching valve 76 to the oil pan 75.

FIG. 5 shows that the passage switching valve 76 is switched to the third position by the solenoid. In the third position, the output portion of the oil pump 70 is shut off from the advance angle oil passage 52 and the retard angle oil passage 53. In a state shown in FIG. 5, a positive pressure is exerted on the hydraulic fluid in the advance angle oil passage 52 and the retard angle oil passage 53. Thus, the pressuring force on the hydraulic fluid in the advance angle oil passage 52 is exerted on the advance angle drain valve 81A through the drainage quitting passage 56, and thus the advance angle drain valve 81A is held at the non-drainage position. Similarly, the pressuring force on the hydraulic fluid of the retard angle oil passage 53 is exerted on the retard angle drain valve 81R through the drainage quitting passage 57, and thus the retard angle drain valve 81R is held at the non-drainage position. Further, the pressuring force on the hydraulic fluid in the advance angle oil passage 52 is exerted on the retard angle auxiliary valve 91R through the retard angle auxiliary operation passage 59, and thus the retard angle auxiliary valve 91R is held at the non-drainage position. Similarly, the pressuring force on the hydraulic fluid of the retard angle oil passage 53 is exerted on the advance angle auxiliary valve 91A through the advance angle auxiliary operation passage 58, and thus the advance angle auxiliary valve 91A is held at the non-drainage position.

As just described, all of the four pilot valves 81A, 91A, 81R and 91R are held at the non-drainage position, and the advance angle oil passage 52 and the retard angle oil passage 53 form a closed circuit in which the passage switching valve 76, which is completely shut off, is serially connected. Thus, the movement of the hydraulic fluid is prevented between the advance angle oil passage 52 and the retard angle oil passage 53, and the relative rotation phase is prevented from displacing. As a result, the opening and closing timing of the valve, relative to the rotation phase of the crankshaft, is constantly maintained at any intermediate position and the like between the most advanced angle position and the most retarded angle position. The foregoing state, in which positive pressures are respectively exerted on the hydraulic fluids in the advance angle 52 and the retard angle 53, is realized by operating the passage switching valve 76 so as to reciprocate between the first and second positions at a relatively high speed. The reciprocating operation allows the hydraulic fluid to be supplied to the advance angle oil passage 52 and the retard angle oil passage 53 at substantially the same timing, and the foregoing state is realized.

Other Embodiment

Figure 6:
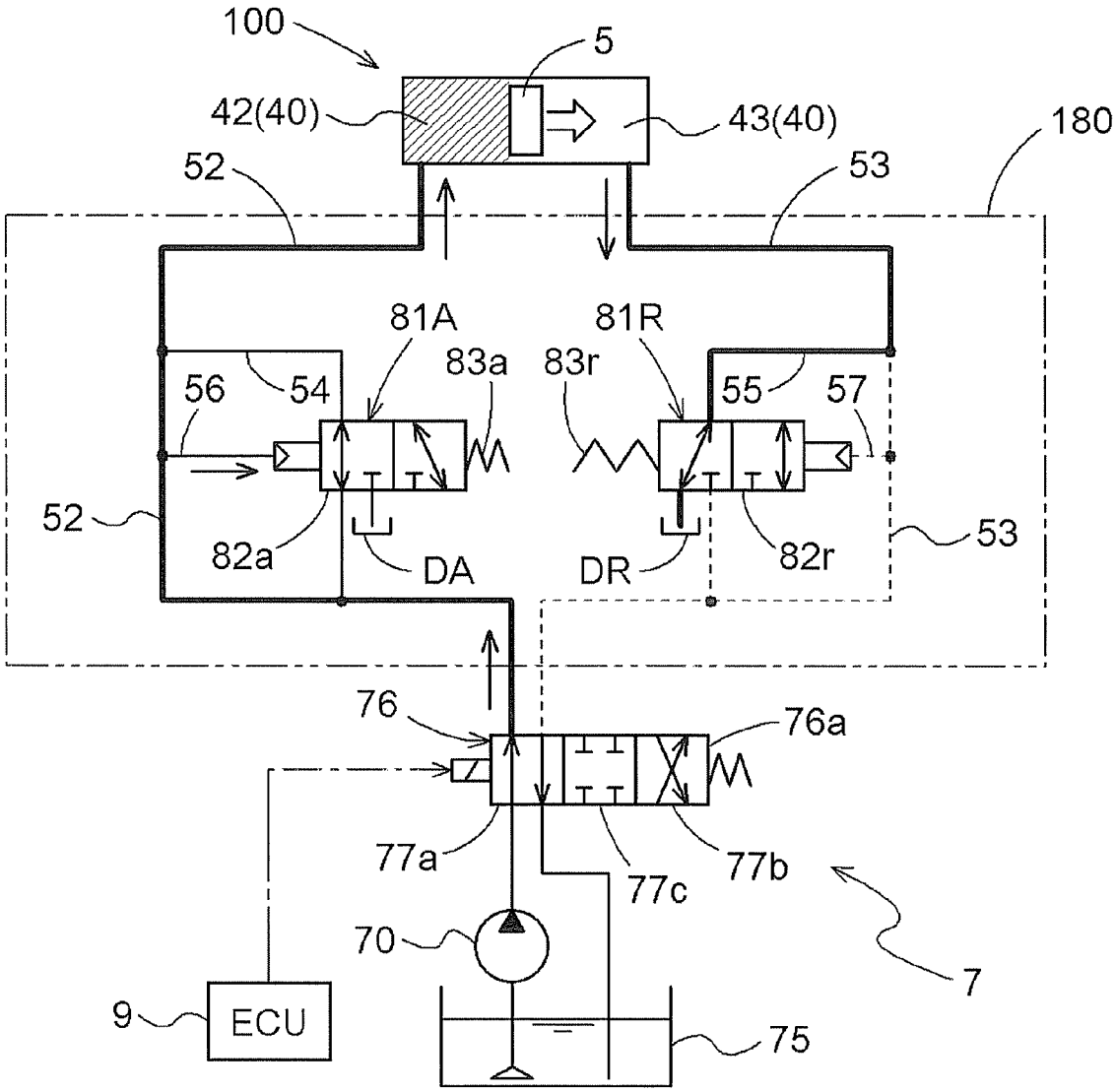
FIG. 6 is a schematic view showing a depressuring drain mechanism according to a second embodiment in a state corresponding to FIG. 3.
Figure 7:
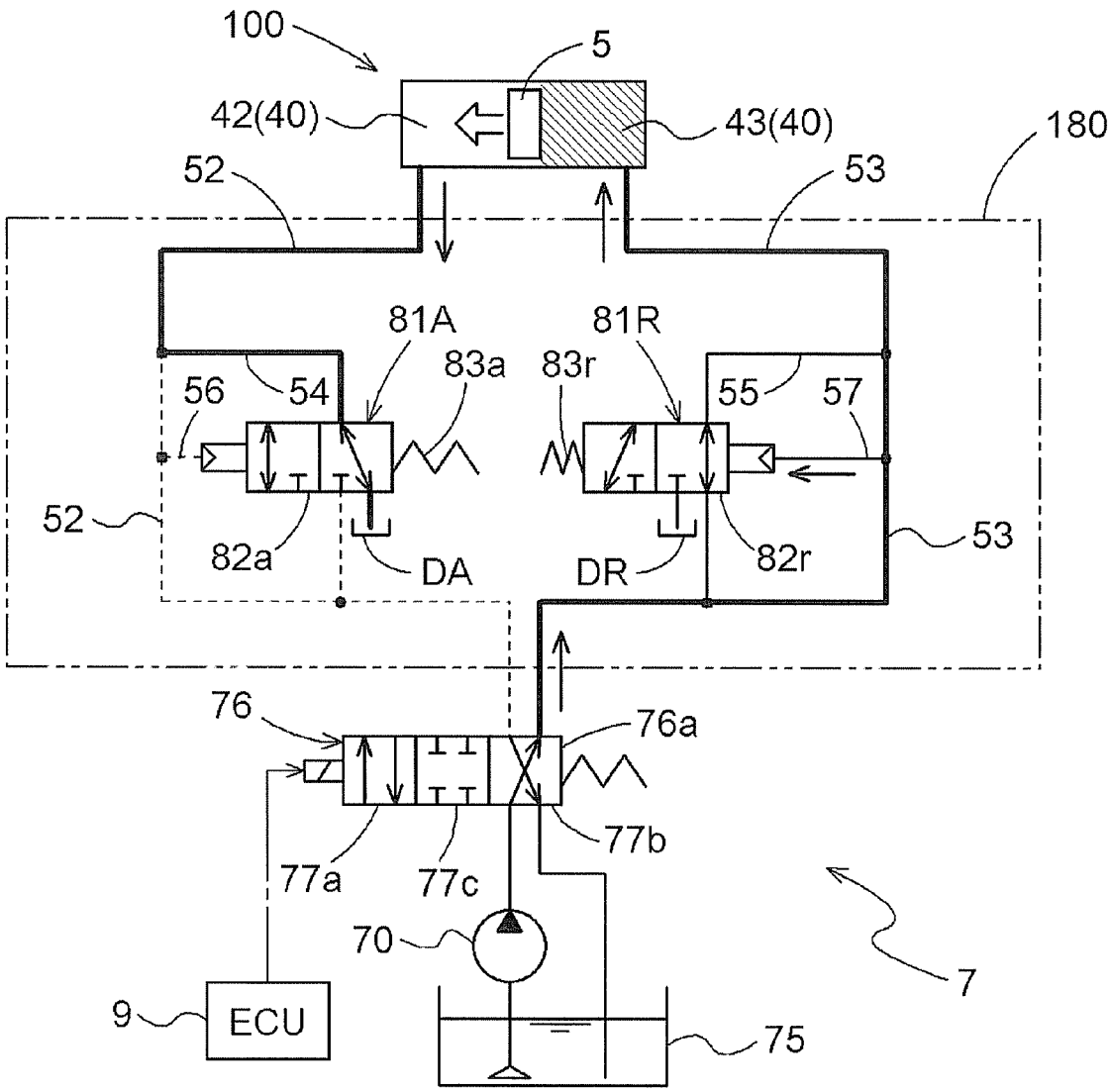
FIG. 7 is a schematic view showing the depressuring drain mechanism according to the second embodiment in a state corresponding to FIG. 4.
Figure 8:
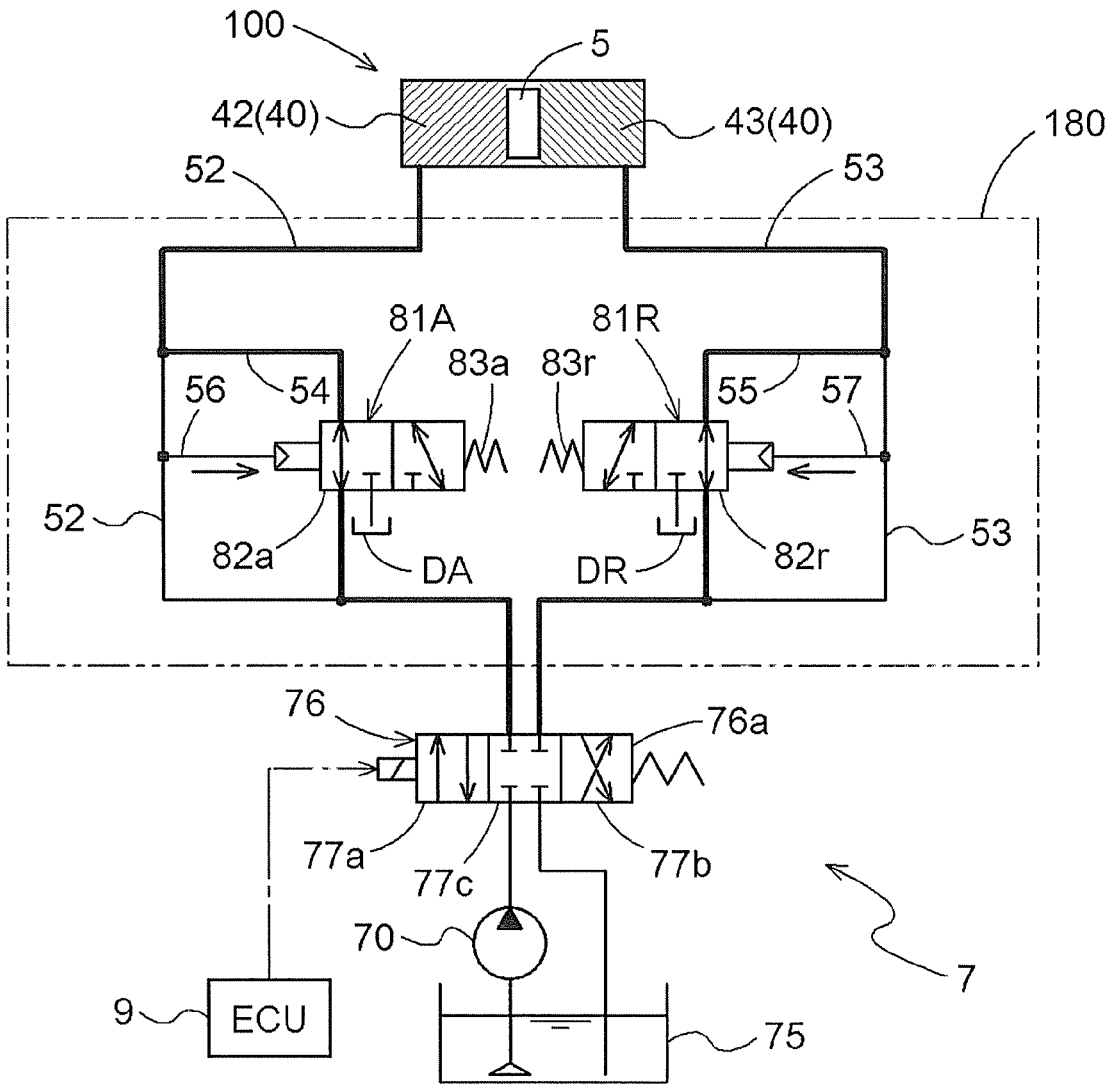
FIG. 8 is a schematic view showing the depressuring drain mechanism according to the second embodiment in a state corresponding to FIG. 5.

A pair of auxiliary valves 91A and 91R, provided at the depressuring drain mechanism 80 according to the foregoing embodiment, are omitted in a depressuring drain mechanism 180 shown in FIGS. 6 to 8, and the depressuring drain mechanism 180 is formed by main drain valves, i.e. the advance angle drain valve 81A and the retard angle drain valve 81R. Even with the depressuring drain mechanism 180 configured in such a simplified form, responsiveness of the valve timing control apparatus is sufficiently enhanced at least in a low speed operating state of the valve timing control apparatus, in which the engine speed is not remarkably high and a large amount of drain from the oil passages is not necessary.

Even in such a simplified configuration, the short advance angle drain passage 54 and the short retard angle drain passage 55 are respectively formed in the advance angle oil passage 52 and the retard angle oil passage 53 so that each passage creates the bypass. The advance angle drain valve 81A is mounted at the intermediate position of the first bypass oil passage 54 of the advance angle oil passage 52, and the retard angle drain valve 81R is mounted at an intermediate position of the second bypass oil passage 55 of the retard angle oil passage 53.

As with the first embodiment, the advance angle drain valve 81A includes the valve body 82*a* changing its position between the drainage position and the non-drainage position and the advance angle first spring 83*a* biasing the valve body 82*a* toward the drainage position, and the retard angle drain valve 81R includes the valve body 82*r* changing its position between the drainage position and the non-drainage position and the retard angle first spring 83*r* biasing the valve body 82*r* toward the drainage position. Further, the drainage quitting passage 56, through which the pressuring force applied to the advance angle oil passage 52 is exerted on the valve body 82*a* to push the valve body 82*a* to the non-drainage position against the biasing force of the advance angle first spring 83*a*, is provided between the valve body 82*a* and the advance angle oil passage 52. Similarly, the drainage quitting passage 57, through which the pressuring force applied to the retard angle oil passage 53 is exerted on the valve body 82*r* to push the valve body 82*r* to the non-drainage position against the biasing force of the retard angle first spring 83*r*, is provided between the valve body 82*r* and the retard angle oil passage 53.

Basically, when the pressuring force for advance angle on the hydraulic fluid becomes smaller than the predetermined value in the advance angle oil passage 52, the advance angle drain valve 81A is operated to be in the drainage state by the biasing force of the advance angle first spring 83*a* as shown in FIG. 7. On the other hand, when the pressuring force for advance angle is exerted on the advance angle oil passage 52, the advance angle drain valve 81A is switched to be in the non-drainage state by the pressuring force exerted through the drainage quitting passage 56 as shown in FIG. 6. Further, when the pressuring force for retard angle on the hydraulic fluid becomes smaller than the predetermined value in the retard angle oil passage 53, the retard angle drain valve 81R is operated to be in the drainage state by the biasing force of the retard angle first spring 83*r* as shown in FIG. 6. On the other hand, when the pressuring force for retard angle is exerted on the retard angle oil passage 53, the retard angle drain valve 81R is switched to be in the non-drainage state by the pressuring force exerted through the drainage quitting passage 57 as shown in FIG. 7.

As shown in FIG. 6, when the solenoid of the passage switching valve 76 is switched to be in its on state, the passage switching valve 76 is positioned at the first position in which the output portion of the oil pump 70 connects with the advance angle oil passage 52, and the hydraulic fluid of the oil pan 75 is supplied to the advance angle oil passage 52 by the oil pump 70. In case that the passage switching valve 76 is held at the first position, the pressuring force on the hydraulic fluid of the advanced angle oil passage 52 increases, and the advance angle drain valve 81A is subject to the oil pressure exerted through the drainage quitting passage 56 to be held at the non-drainage position.

On the other hand, in the state that the hydraulic fluid is supplied only to the advance angle oil passage 52 by the oil pump 70, the sufficient pressuring force is not exerted on the hydraulic fluid of the retard angle oil passage 53. Thus, the sufficient oil pressure is not exerted on the drainage quitting passage 57, and the retard angle drain valve 81R is held at the drainage position. As a result, back pressure existing in the retard angle oil passage 53 is instantly released to the atmosphere through the retard angle drain valve 81R, and the hydraulic fluid is supplied to the advance angle chamber 42 at high efficiency. In a short time period immediately before the retard angle drain valve 81R is switched to be in the drainage position, the hydraulic fluid between the retard angle drain valve 81R and the passage switching valve 76 may be drained from the discharge port of the passage switching valve 76 to the oil pan 75.

On the other hand, as shown in FIG. 7, when the solenoid of the passage switching valve 76 is switched to be in its off state, the passage switching valve 76 is positioned at the second position in which the output portion of the oil pump 70 connects with the retard angle oil passage 53, and the hydraulic fluid in the oil pan 75 is supplied to the retard angle oil passage 53 by the oil pump 70. In case that the passage switching valve 76 is held at the second position, the pressuring force on the hydraulic fluid in the retard angle oil passage 53 increases, and the retard angle drain valve 81R is subject to the oil pressure exerted through the drainage quitting passage 57 to be held at the non-drainage position.

On the other hand, in the state that the hydraulic fluid is supplied only to the retard angle oil passage 53 by the oil pump 70, the sufficient pressuring force is not exerted on the hydraulic fluid of the advance angle oil passage 52. Thus, the sufficient oil pressure is not exerted on the drainage quitting passage 56, and the advance angle drain valve 81A is held at the drainage position. As a result, back pressure existing in the advance angle oil passage 52 is instantly released to the atmosphere through the advance angle drain valve 81A, and the hydraulic fluid is supplied to the retard angle chamber 43 at high efficiency. In a short time period immediately before the advance angle drain valve 81A is switched to be in the drainage position, the hydraulic fluid between the advance angle drain valve 81A and the passage switching valve 76 may be drained from the discharge port of the passage switching valve 76 to the oil pan 75.

FIG. 8 shows that the passage switching valve 76 is switched to the third position by the solenoid. In the third position, the output portion of the oil pump 70 is shut off from the advance angel oil passage 52 and the retard angle oil passage 53. In the state shown in FIG. 8, a positive pressure is exerted on the hydraulic fluid in the advance angle oil passage 52 and the retard angle oil passage 53. Thus, the pressuring force on the hydraulic fluid in the advance angle oil passage 52 is exerted on the advance angle drain valve 81A through the drainage quitting passage 56, and thus the advance angle drain valve 81A is held at the non-drainage position. Similarly, the pressuring force on the hydraulic fluid in the retard angle oil passage 53 is exerted on the retard angle drain valve 81R through the drainage quitting passage 57, and thus the retard angle drain valve 81R is held at the non-drainage position. As just described, the two pilot valves 81A and 81R are simultaneously held at the non-drainage position, and the advance angle oil passage 52 and the retard angle oil passage 53 form a closed circuit in which the passage switching valve 76, which is completely shut off, is serially connected. Thus, the movement of the hydraulic fluid is prevented between the advance angle oil passage 52 and the retard angle oil passage 53, and the relative rotation phase is prevented from displacing. As a result, the opening and closing timing of the valve, relative to the rotation phase of the crankshaft, is constantly maintained at any intermediate position and the like between the most advanced angle position and the most retarded angle position. The state in which positive pressures are respectively exerted on the hydraulic fluid in the advance angle oil passage 52 and the retard angle oil passage 53 is realized by operating the passage switching valve 76 so as to reciprocate between the first and second positions at a relatively high speed. The reciprocating operation allows the hydraulic fluid to be supplied to the advance angle oil passage 52 and the retard angle oil passage 53 at substantially the same timing, and the foregoing state is realized.

According to the embodiment described above, when the hydraulic fluid is supplied to the advance angle chamber 42 by the oil pump 70, the hydraulic fluid in the retard angle chamber 43, located at the opposite side of the advance angle chamber 42, is discharged before the passage switching valve 76, not after passing the retard angle oil passage 53 and the passage switching valve 76. Thus, the occurrence of the back pressure resistance against the hydraulic fluid becomes more difficult in the retard angle oil passage 53. Therefore, the relative rotation phase is rapidly displaced, and the responsiveness of the valve timing control apparatus is enhanced. When the hydraulic fluid is supplied to the retard angle chamber 43 by the oil pump 70, the responsiveness of the valve timing control apparatus is enhanced in a similar manner.

According to the embodiment, the drain mechanism 80 includes the advance angle drain valve 81A, which is turned into the non-drainage state by the pressuring force for advance angle on the hydraulic fluid in the advance angle oil passage 52 and is switched to the drainage state when the pressuring force for advance angle becomes smaller than the predetermined value, and the drain mechanism 80 further includes the retard angle drain valve 81R, which is turned into the non-drainage state by the pressuring force for retard angle on the hydraulic fluid in the retard angle oil passage 53 and is switched to the drainage state when the pressuring force for retard angle becomes smaller than the predetermined value.

In the configure described above, the hydraulic fluid is supplied to each chamber smoothly in response to the switching operation of the passage switching valve 76. For example, in case that the pressuring force for advance angle, which is exerted to the hydraulic fluid in the advance angle oil passage 52, is maintained, the advance angle drain valve 81A is automatically turned into the non-drainage state, and the hydraulic fluid is supplied to the advance angle chamber 42 smoothly. At the same time, the pressuring force for retard angle becomes smaller than the predetermined value in the retard angle oil passage 53, and thus the retard angle drain valve 81R is automatically turned into the drainage state to prevent the increase of the back pressure of the hydraulic fluid in the retard angle oil passage 53. When the pressuring force for retard angle is exerted on the hydraulic fluid in the retard angle oil passage 53, the hydraulic fluid is supplied to the retard angle chamber 43 smoothly on the same principle and the increase of the back pressure of the hydraulic fluid in the advance angle oil passage 52 is assuredly prevented. As a result, the responsiveness of the valve timing control apparatus is sufficiently enhanced at least in a low speed operation of the valve timing control apparatus in which the engine speed is not remarkably high and a small amount of the hydraulic fluid is to be discharged from the oil passage.

According to the embodiment, the passage switching valve 76 may be switched to the third position in which the output portion of the oil pump 70 is shut off from the advance angle oil passage 52 and the retard angle oil passage 53.

In the configuration, the output portion of the oil pump 70 may be shut off from the advanced angle oil passage 52 and the retard angle oil passage 53. Thus, if the passage switching valve 76 is positioned at the third position after the puressuring force is increased in the retard angle oil passage 53 and the advance angle oil passage 52 to hold the advance angle drain valve 81A and the retard angle drain valve 81R at the non-drainage position, the relative rotation phase is held at the intermediate phase lied between the most advanced angle position and the most retarded angle position in a sufficiently stable manner.

According to the embodiment, the advance angle drain valve 81A and the retard angle drain valve 81R respectively include the valve bodies 82*a* and 82*r*, each changing its position between the drainage position and the non-drainage position, and the springs 83*a* and 83*r*, each biasing the corresponding valve body 82*a* or 82*r* toward the drainage position. Further, the drainage quitting passages 56 and 57, through which the oil pressure is exerted on the valve bodies 82*a* and 82*r* to the non-drainage position against the biasing force of the springs 83*a* and 83*r*, are provided between the valve body 82*a* of the advance angle drain valve 81A and the advance angle oil passage 52 and between the valve body 82*r* of the retard angle drain valve 81R and the retard angle oil passage 53.

In the configuration described above, when operating the advance angle drain valve 81A and the retard angle drain valve 81R, an actuator, such as an electrical motor, does not need to be used. The advance and retard angle drain valves 81A and 81R are operated by the pressuring force on the hydraulic fluid in the advance and retard angle oil passages 52 and 53. The pressuring force is generated by the oil pressure from the oil pump 70.

According to the embodiment, the retard angle auxiliary valve 91R, ensuring the drainage state of the retard angle drain valve 81R by the pressuring force for advance angle on the hydraulic fluid in the advance angle oil passage 52, and the advance angle auxiliary valve 91A, ensuring the drainage state of the advance angle drain valve 81A by the pressuring force for retard angle on the hydraulic fluid in the retard angle oil passage 53, is provided.

In the configuration described above, the back pressure is stably prevented in the advance angle oil passage 52 or the retard angle oil passage 53. For example, when the situation, in which the pressuring force for advance angle is exerted on the hydraulic fluid in the advance angle oil passage 52, is maintained, the retard angle drain valve 81R is held at the drainage position and the back pressure is stably prevented in the retard angle oil passage 53. Similarly, when the situation, in which the pressuring force for retard angle is exerted on the hydraulic fluid in the retard angle oil passage 53, is maintained, the advance angle drain valve 81A is held at the drainage position and the back pressure is stably prevented in the advance angle oil passage 52. As a result, the responsiveness of the valve timing control apparatus is sufficiently enhanced even in a high speed operation of the valve timing control apparatus in which the engine speed is remarkably high and a large amount of the hydraulic fluid needs to be discharged from the passage.

The principles, of the preferred embodiments and mode of operation of the present invention have been described in the foregoing specification. However, the invention, which is intended to be protected, is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A valve timing control apparatus comprising:

a driving rotation member synchronously rotating with a crankshaft of an internal combustion engine;

a driven rotation member coaxially arranged with the driving rotation member and synchronously rotating with a camshaft for opening and closing a valve of the internal combustion engine;

an advance angle chamber defined by the driving rotation member and the driven rotation member, the advance angle chamber displacing a rotation phase of the driven rotation member relative to the driving rotation member in an advance angle direction when the hydraulic fluid is supplied to the advance angle chamber;

a retard angle chamber defined by the driving rotation member and the driven rotation member, the retard angle chamber displacing the rotation phase of the driven rotation member relative to the driving rotation member in a retard angle direction when the hydraulic fluid is supplied to the retard angle chamber;

an advance angle oil passage through which the hydraulic fluid is supplied to or discharged from the advance angle chamber;

a retard angle oil passage through which the hydraulic fluid is supplied to or discharged from the retard angle chamber;

an oil pump supplying the hydraulic fluid to the advance angle oil passage and the retard angle oil passage;

a passage switching valve switching a position thereof between a first position, in which an output portion of the oil pump communicates with the advance angle oil passage, and a second position, in which the output portion of the oil pump communicates with the retard angle oil passage;

a retard angle oil passage drain mechanism between the retard angle chamber and the passage switching valve to release the hydraulic fluid in the retard angle oil passage to atmosphere between the retard angle chamber and the passage switching valve when the hydraulic fluid is supplied to the advance angle chamber through the advance angle oil passage by the oil pump; and an advance angle oil passage drain mechanism between the advance angle chamber and the passage switching valve to release the hydraulic fluid in the advance angle oil passage to atmosphere between the advance angle chamber and the passage switching valve when the hydraulic fluid is supplied to the retard angle chamber through the retard angle oil passage by the oil pump.

2. A valve timing control apparatus according to claim 1, wherein the advance angle oil passage drain mechanism has an advance angle drain valve turned into a non-drainage state when a pressuring force for advance angle on the hydraulic fluid in the advance angle oil passage exceeds a first predetermined value and the advance angle drain valve is switched to a drainage state when the pressuring force for advance angle is equal to or less than the first predetermined value, and the retard angle oil passage drain mechanism has a retard angle drain valve turned into a non-drainage state when a pressuring force for retard angle on the hydraulic fluid in the retard angle oil passage exceeds a second predetermined value and the retard angle drain valve is switched to a drainage state when the pressuring force for retard angle is equal to or less than the second predetermined value.

3. A valve timing control apparatus according to claim 1, wherein the passage switching valve is switched to a third position in which the output portion of the oil pump is shut off from the advance angle oil passage and the retard angle oil passage.

4. A valve timing control apparatus according to claim 2, wherein the advance angle drain valve includes a valve body being changeable between a drainage position and a non-drainage position and a spring biasing the valve body toward the drainage position, and an operation passage, through which a pressuring force is exerted on the valve body to push the valve body toward the non-drainage position against a biasing force of the spring, is provided between the valve body of the advance angle drain valve and the advance angle oil passage, wherein the retard angle drain valve includes a valve body being changeable between the drainage position and the non-drainage position and a spring biasing the valve body toward the drainage position, and an operation passage, through which a pressuring force is exerted on the valve body to push the valve body toward the non-drainage position against a biasing force of the spring, is provided between the valve body of the retard angle drain valve and the retard angle oil passage.

5. A valve timing control apparatus according to claim 2, wherein the retard angle oil passage drain mechanism further includes a retard angle auxiliary valve ensuring the drainage state of the retard angle drain valve by the pressuring force for advance angle on the hydraulic fluid in the advance angle oil passage, and the advance angle oil passage drain mechanism further includes an advance angle auxiliary valve ensuring the drainage state of the advance angle drain valve by the pressuring force for retard angle on the hydraulic fluid in the retard angle oil passage.

6. A valve timing control apparatus according to claim 1, wherein the advance angle oil passage drain mechanism has an advance angle drain valve which is switched between an advance angle drainage position in which the hydraulic fluid is discharged from the advance angle oil passage and an advance angle non-drainage position in which the hydraulic fluid is prevented from being discharged from the advance angle oil passage, and the advance angle drain valve is switched from the advance angle drainage position to the advance angle non-drainage position when the hydraulic fluid pressure of the advance angle oil passage exceeds a first predetermined value, wherein the retard angle oil passage drain mechanism has a retard angle drain valve which is switched between a retard angle drainage position in which the hydraulic fluid is discharged from the retard angle oil passage and a retard angle non-drainage position in which the hydraulic fluid is prevented from being discharged from the retard angle oil passage, and the retard angle drain valve is switched from the retard angle drainage position to the retard angle non-drainage position when the hydraulic fluid pressure of the retard angle oil passage exceeds a second predetermined value.

7. A valve timing control apparatus according to claim 6, wherein the advance angle oil passage drain mechanism further includes an advance angle drain receiver for receiving the hydraulic fluid discharged from the advance angle oil passage, and the advance angle drain valve is switched between the advance angle drainage position, in which the advance angle oil passage communicates with the advance angle drain receiver, and the advance angle non-drainage position, in which communication is shut off between the advance angle oil passage and the advance angle drain receiver, based on the hydraulic fluid pressure in the advance angle oil passage, wherein the retard angle oil passage drain mechanism further includes a retard angle drain receiver for receiving the hydraulic fluid discharged from the retard angle oil passage, and the retard angle drain valve is switched between the retard angle drainage position, in which the retard angle oil passage communicates with the retard angle drain receiver, and the retard angle non-drainage position, in which communication is shut off between the retard angle oil passage and the retard angle drain receiver, based on the hydraulic fluid pressure in the retard angle oil passage.

8. A valve timing control apparatus according to claim 6, wherein the advance angle drain valve is switched between the advance angle drainage position, in which the hydraulic fluid is discharged from the advance angle oil passage, and the advance angle non-drainage position, in which the hydraulic fluid is prevented from being discharged from the advance angle oil passage and the advance angle chamber is in communication with the passage switching valve through the advance angle oil passage, based on the hydraulic fluid pressure in the advance angle oil passage, wherein the retard angle drain valve is switched between the retard angle drainage position, in which the hydraulic fluid is discharged from the retard angle oil passage, and the retard angle non-drainage position, in which the hydraulic fluid is prevented from being discharged from the retard angle oil passage and the retard angle chamber is in communication with the passage switching valve through the retard angle oil passage, based on the hydraulic fluid pressure in the retard angle oil passage.

9. A valve timing control apparatus according to claim 6, wherein at least one of the advance angle drain valve and the retard angle drain valve is mechanically switched between the non-drainage position and the drainage position based on at least one of the hydraulic fluid pressures in the advanced angle oil passage and the retard angle oil passage, which are connected with at least the one of the advance angle drain valve and the retard angle drain valve.

10. A valve timing control apparatus according to claim 1, wherein the retard angle oil passage drain mechanism and advance angle oil passage drain mechanism are provided inside the camshaft.

11. A valve timing control apparatus according to claim 2, wherein the advance angle oil passage drain mechanism further includes an advance angle bypass oil passage which is branched from and merged into the advance angle oil passage between the passage switching valve and the advance angle chamber, and the advance angle drain valve is provided at the advance angle bypass oil passage, wherein the retard angle oil passage drain mechanism further includes a retard angle bypass oil passage which is branched from and merged into the retard angle oil passage between the passage switching valve and the retard angle chamber, and the retard angle drain valve is provided at the retard angle bypass oil passage.

12. A valve timing control apparatus according to claim 1, wherein the drain mechanism is connected with at least one of the advance angle oil passage and the retard angle oil passage.

13. A valve timing control apparatus comprising:

a driving rotation member synchronously rotating with a crankshaft of an internal combustion engine;

a driven rotation member coaxially arranged with the driving rotation member and synchronously rotating with a camshaft for opening and closing a valve of the internal combustion engine;

an advance angle chamber defined by the driving rotation member and the driven rotation member, the advance angle chamber displacing a rotation phase of the driven rotation member relative to the driving rotation member in an advance angle direction when the hydraulic fluid is supplied to the advance angle chamber;

a retard angle chamber defined by the driving rotation member and the driven rotation member, the retard angle chamber displacing the rotation phase of the driven rotation member relative to the driving rotation member in a retard angle direction when the hydraulic fluid is supplied to the retard angle chamber;

an advance angle oil passage through which the hydraulic fluid is supplied to or discharged from the advance angle chamber;

a retard angle oil passage through which the hydraulic fluid is supplied to or discharged from the retard angle chamber;

an oil pump supplying the hydraulic fluid to the advance angle oil passage and the retard angle oil passage;

a passage switching valve switching a position thereof between a first position, in which an output portion of the oil pump communicates with the advance angle oil passage, and a second position, in which the output portion of the oil pump communicates with the retard angle oil passage;

a drain mechanism provided between the passage switching valve and at least one of the advance angle chamber and the retard angle chamber for accelerating discharge of the hydraulic fluid from one of the advance angle chamber and the retard angle chamber when the hydraulic fluid is supplied to the other of the advance angle chamber and the retard angle chamber;

wherein the drain mechanism includes a retard angle oil passage drain mechanism which is provided between the retard angle chamber and the passage switching valve and accelerates the discharge of the hydraulic fluid from the retard angle oil passage when the hydraulic fluid is supplied to the advance angle chamber through the advance angle oil passage by the oil pump, and the drain mechanism further includes an advance angle oil passage drain mechanism which is provided between the advance angle chamber and the passage switching valve and accelerates the discharge of the hydraulic fluid from the advance angle oil passage when the hydraulic fluid is supplied to the retard angle chamber through the retard angle oil passage by the oil pump;

wherein the advance angle oil passage drain mechanism has an advance angle drain valve which is switched between an advance angle drainage position in which the hydraulic fluid is discharged from the advance angle oil passage and an advance angle non-drainage position in which the hydraulic fluid is prevented from being discharged from the advance angle oil passage, and the advance angle drain valve is switched from the advance angle drainage position to the advance angle non-drainage position when the hydraulic fluid pressure of the advance angle oil passage exceeds a first predetermined value, wherein the retard angle oil passage drain mechanism has a retard angle drain valve which is switched between a retard angle drainage position in which the hydraulic fluid is discharged from the retard angle oil passage and a retard angle non-drainage position in which the hydraulic fluid is prevented from being discharged from the retard angle oil passage, and the retard angle drain valve is switched from the retard angle drainage position to the retard angle non-drainage position when the hydraulic fluid pressure of the retard angle oil passage exceeds a second predetermined value; and wherein the retard angle oil passage drain mechanism further includes a retard angle auxiliary valve discharging the hydraulic fluid in the retard angle chamber through the retard angle oil passage and the retard angle drain valve when the hydraulic fluid pressure in the advance angle oil passage exceeds a third predetermined value, and the advance angle oil passage drain mechanism further includes an advance angle auxiliary valve discharging the hydraulic fluid in the advance angle oil chamber through the advance angle oil passage and the advance angle drain valve when the hydraulic fluid pressure in the retard angle oil passage exceeds a fourth predetermined value.

14. A valve timing control apparatus according to claim 13, wherein the retard angle auxiliary valve allows the retard angle chamber to communicate with the passage switching valve through the retard angle oil passage when the hydraulic fluid pressure in the advance angle oil passage is equal to or less than the third predetermined value, and the advance angle auxiliary valve allows the advance angle chamber to communicate with the passage switching valve through the advance angle oil passage when the hydraulic fluid pressure in the retard angle oil passage is equal to or less than the fourth predetermined value.

15. A valve timing control apparatus comprising:

a driving rotation member synchronously rotating with a crankshaft of an internal combustion engine;

a driven rotation member coaxially arranged with the driving rotation member and synchronously rotating with a camshaft for opening and closing a valve of the internal combustion engine;

an advance angle chamber defined by the driving rotation member and the driven rotation member, the advance angle chamber displacing a rotation phase of the driven rotation member relative to the driving rotation member in an advance angle direction when the hydraulic fluid is supplied to the advance angle chamber;

a retard angle chamber defined by the driving rotation member and the driven rotation member, the retard angle chamber displacing the rotation phase of the driven rotation member relative to the driving rotation member in a retard angle direction when the hydraulic fluid is supplied to the retard angle chamber;

an advance angle oil passage through which the hydraulic fluid is supplied to or discharged from the advance angle chamber;

a retard angle oil passage through which the hydraulic fluid is supplied to or discharged from the retard angle chamber;

an oil pump supplying the hydraulic fluid to the advance angle oil passage and the retard angle oil passage;

a passage switching valve switching a position thereof between a first position, in which an output portion of the oil pump communicates with the advance angle oil passage, and a second position, in which the output portion of the oil pump communicates with the retard angle oil passage; and a drain mechanism between the passage switching valve and at least one of the advance angle chamber and the retard angle chamber to release the hydraulic fluid from one of the advance angle chamber and the retard angle chamber to an atmosphere without passing the passage switching valve when the hydraulic fluid is supplied to the other of the advance angle chamber and the retard angle chamber.

* * * * *